US010577811B2

(12) United States Patent
Negri et al.

(10) Patent No.: US 10,577,811 B2
(45) Date of Patent: Mar. 3, 2020

(54) PREFILL TOOL FOR FINISHING WALLBOARD JOINTS

(71) Applicant: UNITED STATES GYPSUM COMPANY, Chicago, IL (US)

(72) Inventors: Robert H. Negri, Lake Villa, IL (US); Aaron St. James, Surrey (CA); Elliott St. James, Surrey (CA); Bernie St. James, Surrey (CA); David J. Pekarcik, Garden Grove, CA (US); Jeffrey Samuel Zunk, Stanton, MI (US); Rafael Bury, Wheeling, IL (US); Pamela Hargrove, Cary, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 158 days.

(21) Appl. No.: 15/642,985

(22) Filed: Jul. 6, 2017

(65) Prior Publication Data

US 2019/0010713 A1 Jan. 10, 2019

(51) Int. Cl.

| | |
|---|---|
| ***E04F 21/165*** | (2006.01) |
| ***E04F 21/06*** | (2006.01) |
| ***E04F 21/02*** | (2006.01) |

(52) U.S. Cl.

CPC ..... *E04F 21/1652* (2013.01); *E04F 21/023* (2013.01); *E04F 21/06* (2013.01); *E04F 21/165* (2013.01); *E04F 21/1655* (2013.01)

(58) Field of Classification Search

CPC ..... E04F 21/1652; E04F 21/165; E04F 21/06; E04F 21/023

USPC ..... 401/137–139, 193, 261–266, 48, 5

See application file for complete search history.

(56) References Cited

U.S. PATENT DOCUMENTS

| | | | | |
|---|---|---|---|---|
| 2,711,098 | A | 6/1955 | Ames | |
| 2,824,442 | A | 2/1958 | Ames | |
| 2,889,699 | A | 6/1959 | Ames | |
| 2,984,857 | A | 5/1961 | Ames | |
| 3,103,033 | A | 9/1963 | Ames | |
| 3,116,511 | A | 1/1964 | Hoveland | |
| 3,334,792 | A * | 8/1967 | Piencinski | B05C 5/0254 425/87 |
| 3,451,757 | A | 6/1969 | Stroud et al. | |
| 3,602,405 | A | 8/1971 | Ames | |

(Continued)

FOREIGN PATENT DOCUMENTS

| | | | |
|---|---|---|---|
| CA | 2494477 | A1 | 7/2005 |
| DE | 202017101239 | U1 | 5/2017 |

OTHER PUBLICATIONS

International Search Report from International Patent Application No. PCT/US2018/040563, dated Oct. 11, 2018.

*Primary Examiner* — Erin Deery

(74) *Attorney, Agent, or Firm* — Greer, Burns & Crain, Ltd.; Pradip Sahu; Philip T. Petti

(57) ABSTRACT

A prefill tool for finishing wallboard joints is provided for finishing a wallboard joint, and includes a box assembly defining a hopper, having a top wall and a front wall constructed and arranged for engaging the wallboard joint. The front wall partially defines a gate dimensioned for dispensing joint compound stored in the hopper. Also, the gate is located on a skid plate mounted on the front wall, the skid plate having a main portion, and a gate portion partially defining the gate being displaced from a plane defined by the main portion.

9 Claims, 12 Drawing Sheets

(56) References Cited

U.S. PATENT DOCUMENTS

| | | | | |
|---|---|---|---|---|
| 3,888,611 | A * | 6/1975 | Ames | E04F 21/00 401/48 |
| 3,932,101 | A | 1/1976 | Johnson et al. | |
| 4,086,121 | A | 4/1978 | Ames | |
| 4,451,223 | A | 5/1984 | Mower et al. | |
| 4,516,868 | A | 5/1985 | Molnar | |
| 4,750,968 | A | 6/1988 | Sweeny | |
| 5,137,386 | A | 8/1992 | Mower | |
| 5,143,264 | A | 9/1992 | MacMillan | |
| 5,263,836 | A | 11/1993 | Tinawong | |
| 5,670,182 | A | 9/1997 | Mower | |
| 5,814,351 | A | 9/1998 | Mower | |
| 5,882,691 | A | 3/1999 | Conboy | |
| 6,146,039 | A | 11/2000 | Pool et al. | |
| 6,581,805 | B2 | 6/2003 | Conboy et al. | |
| 6,874,557 | B2 | 4/2005 | Jungklaus | |
| 6,874,965 | B1 | 4/2005 | Mondloch et al. | |
| 7,318,716 | B2 | 1/2008 | Castagnetta, Jr. | |
| 7,338,270 | B2 | 3/2008 | Mathews | |
| 7,473,085 | B2 | 1/2009 | Schlecht | |
| 7,624,782 | B2 | 12/2009 | Jungklaus et al. | |
| 7,674,059 | B2 | 3/2010 | Daigle | |
| 7,806,613 | B2 | 10/2010 | Mondloch et al. | |
| 8,231,371 | B1 | 7/2012 | Jalbert | |
| 8,251,685 | B1 | 8/2012 | Jalbert et al. | |
| 8,523,467 | B2 | 9/2013 | Murray | |
| 8,555,452 | B2 | 10/2013 | Murray | |
| 8,647,094 | B1 | 2/2014 | Jalbert | |
| 8,747,006 | B2 | 6/2014 | Payne | |
| 8,826,961 | B2 | 9/2014 | Castagnetta et al. | |
| 8,851,773 | B2 | 10/2014 | Gill | |
| 9,359,777 | B2 | 6/2016 | Jungklaus et al. | |
| 9,464,447 | B2 | 10/2016 | Wilson et al. | |
| 9,512,626 | B1 | 12/2016 | Murray | |
| 2001/0003563 | A1 | 6/2001 | Schauer et al. | |
| 2004/0165932 | A1 | 8/2004 | Grayden | |
| 2007/0261334 | A1 | 11/2007 | Conboy | |
| 2007/0297843 | A1 | 12/2007 | Castagnetta, Jr. | |
| 2013/0017337 | A1 | 1/2013 | Schlecht et al. | |

* cited by examiner

PREFILL TOOL FOR FINISHING WALLBOARD JOINTS

BACKGROUND

The present invention relates to the finishing of wallboard panel joints in the course of interior construction, and more specifically to the filling of joints between adjacent panels using a combination of wallboard joint compound and tape.

In the construction field, and particularly in interior construction, walls are commonly formed with a plurality of abutting wallboard panels or the like used to construct interior walls. A wall joint is formed at a location where two panels meet. Such joints are either flat, when forming interior wall panels, or also at inside and outside corners when common edges of adjacent panels meet at angles to each other than 0 or 180°. To provide a smooth, continuous wall appearance, joint tape is applied to the wall joint. Tape is either applied to the wall joints by hand, or using devices commonly referred to as taper or taping tools.

Prior to the application of joint tape, it is customary to prefill the joint with joint compound. There are several categories of joint compounds. Drying type compounds harden through the evaporation of water, whereas setting type joint compounds chemically react with water during the curing process. Setting type joint compounds typically use calcium sulfate hemihydrate, also known as stucco or plaster of Paris, as a base. When water is added to the setting type powder, it reacts with the calcium sulfate hemihydrate via a hydration reaction to form an interlocking matrix of calcium sulfate dihydrate crystals. The interlocking crystal matrix gives the compound increased strength. The benefit of a setting type joint compound over a drying type is the overall strength of the finished joint, resulting in less shrinking and cracking, as well as an independence from having to wait for the joint compound to be completely dry prior to further finishing. Drying type joint compounds have the advantage of ease of use, as they typically come in a ready mixed form, with water being added and mixed by the manufacturer. A third type of joint compound combines the setting action of a calcium sulfate hemihydrate based compound with the ease of use of a ready mixed compound.

Taper or taping tools apply a viscous filling and adhering material in the form of joint compound to the joint tape and subsequently apply the compound and tape to a wall joint. Such joint compound is also commonly referred to as mud. A variety of taper tools, also referred to as automatic dispensing devices, exist in the market place, but the taper tools generally operate in a similar manner. Initially, the taper tool is used to apply the tape and joint compound to a wall joint. The tape exits the tool from its first or forward end. After the taper tool reaches the top or bottom of the joint (depending on which direction the operator is applying the tape and compound) and completes tape application for the particular wall joint, the operator activates a cutting mechanism used to cut the tape. Typically, the cutting mechanism is disposed on and behind the forward end of the taper tool.

Accordingly, for the next application of tape to the wall surface, the tape must be advanced to the forward end of the taper tool. This can be performed by either manually grasping the tape and feeding the tape to the forward end, or by a tape advancing assembly, which is also connected to the taper tool. The tape advancing assembly is actuatable by the operator and engages the tape to advance the leading edge of the tape toward the forward end of the taper tool. Suitable exemplary taping tools are disclosed in U.S. Pat. Nos. 4,086,121; 5,882,691; 6,581,805; 6,874,557; 7,624,782 and US Patent Application Publication No. US 2007/0261334, all of which are incorporated by reference.

Unfortunately, in many cases, advancing the leading edge of the tape in either of these manners does not provide tape with sufficient wallboard joint compound applied. Accordingly, the portion of the tape without compound will not stick to the wall surface and will not provide an effective seal between wall sections. Thus, many applicators apply the extra required wallboard joint compound by hand. Other drawbacks of conventional taping tools relate to the significant volume of joint compound required for properly adhering the tape to the wall joint, and the frequent difficulty in obtaining a good adhesive bond between the tape and the joint.

Mechanical pre-fill tool applicators, also known as finishing boxes are known in the art and are described in U.S. Pat. Nos. 2,824,442; 2,889,699; and 2,984,857 incorporated by reference, among others. Such devices include an enclosed, wedge-shaped hopper having a generally flat surface facing the wallboard joint, and provided with an elongate opening or gate through which the joint compound is extruded. Opposite the flat surface, the hopper is defined by a movable pressure plate. Once the hopper is filled with joint compound, the user places the device on the joint, and exerts pressure on the pressure plate as the unit is drawn down the length of the joint. This operator-generated pressure is often exerted through the use of an elongated extension handle that is well known in the art. As the pressure plate moves towards the gate, the wallboard joint compound is extruded into the joint. A screed or wiper bar or blade is often provided to smooth the extruded joint compound.

Such devices are usually used for flat joints having both tapered and square edges. Variations of these devices are used to finish inside corner or angle joints. The latter group of devices is disclosed in U.S. Pat. Nos. 5,263,836; 4,451,223 and 3,932,101. These mechanical applicator devices effectively and efficiently dispense the necessary amount of material to adequately pre-fill a joint prior to taping and finishing. The novel mechanical applications are superior in terms of speed and reproducibility compared to the widespread job practice of manual hand application methods with a broad knife or trowel.

However, known finishing boxes have encountered inconsistent results in providing smooth, suitably tapered and/or flat wallboard joints. Also, the conventional corner tools are relatively complicated to operate by many applicators.

Accordingly, there is a need for an improved system for applying sufficient amounts or wallboard joint compound to wallboard joints that addresses the shortcomings of the conventional practices discussed above.

SUMMARY

The above-listed needs are met or exceeded by the present prefill tool for finishing wallboard joints, which provides a mechanical applicator for wallboard joint compound to joints, independent of the application of wallboard tape. A feature of the present tool is an application gate that dispenses and spreads the joint compound evenly across and over the target area of the joint seam. In addition, the gate is defined in part by a skid plate displaced from a plane of the front or joint facing surface. In the preferred embodiment, the skid plate features a beveled or tapered edge opposite the gate in a direction of travel of the tool along the wall. Opposite the beveled edge, the tool is also provided with an adjustable screed blade that levels the joint compound extruded from the gate.

Another aspect of the present tool is an inside angle joint pre-fill applicator with an application gate located in a central frame member. The inside angle applicator tool features an application gate and screed edge configuration that dispenses and spreads the joint compound more evenly across the target area of the joint seam. A skid plate guides the delivery and spread of the material into the inside angle joint.

More specifically, a prefill tool for finishing wallboard joints is provided for finishing a wallboard joint, and includes a box assembly defining a hopper, having a top wall and a front wall constructed and arranged for engaging the wallboard joint. The front wall partially defines a gate dimensioned for dispensing joint compound stored in the hopper. Also, the gate is located on a skid plate mounted on the front wall, the skid plate having a main portion, and a gate portion partially defining the gate being displaced from a plane defined by the main portion.

In another embodiment, a prefill tool for finishing a wallboard joint is provided, including a box assembly defining a hopper, having a top wall and a front wall constructed and arranged for engaging the wallboard joint, and a pair of guide wheels mounted to the box assembly. The front wall partially defines a gate dimensioned for dispensing joint compound stored in the hopper, and the gate is partially defined on a skid plate mounted on the front wall, the skid plate having a main portion, and a gate portion partially defining the gate is vertically displaced from a plane defined by the main portion. A screed blade is associated with the box assembly; and the gate has an inclined wall directed towards the hopper, and has a base adjacent the screed blade.

In a further embodiment, a prefill corner applicator for applying wallboard joint compound to inside corners is provided, including a housing defining a hopper dimensioned for storing a supply of the joint compound, the hopper defined in part by a pair of guide wings each forming half of an angle complementary to the corner, a frame connected to the hopper and having a first end with a gate in fluid communication with the hopper, and a second end having a pair of guide wheels, and at least one of the housing and the frame having a connection point for a handle or wand.

DETAILED DESCRIPTION

Figure 1:
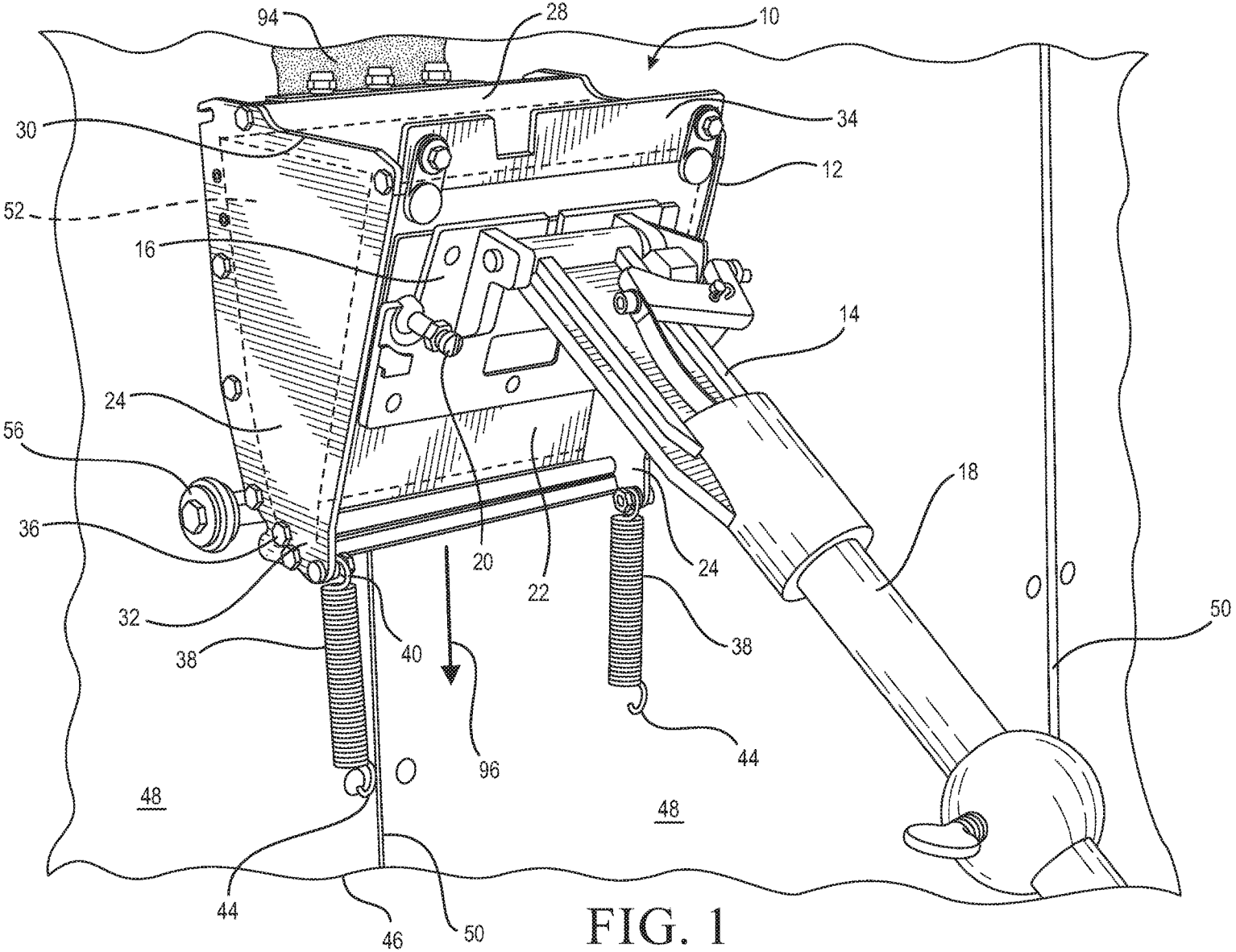
FIG. 1 is a top perspective view of the present prefill tool in use on a wall.
Figure 2:
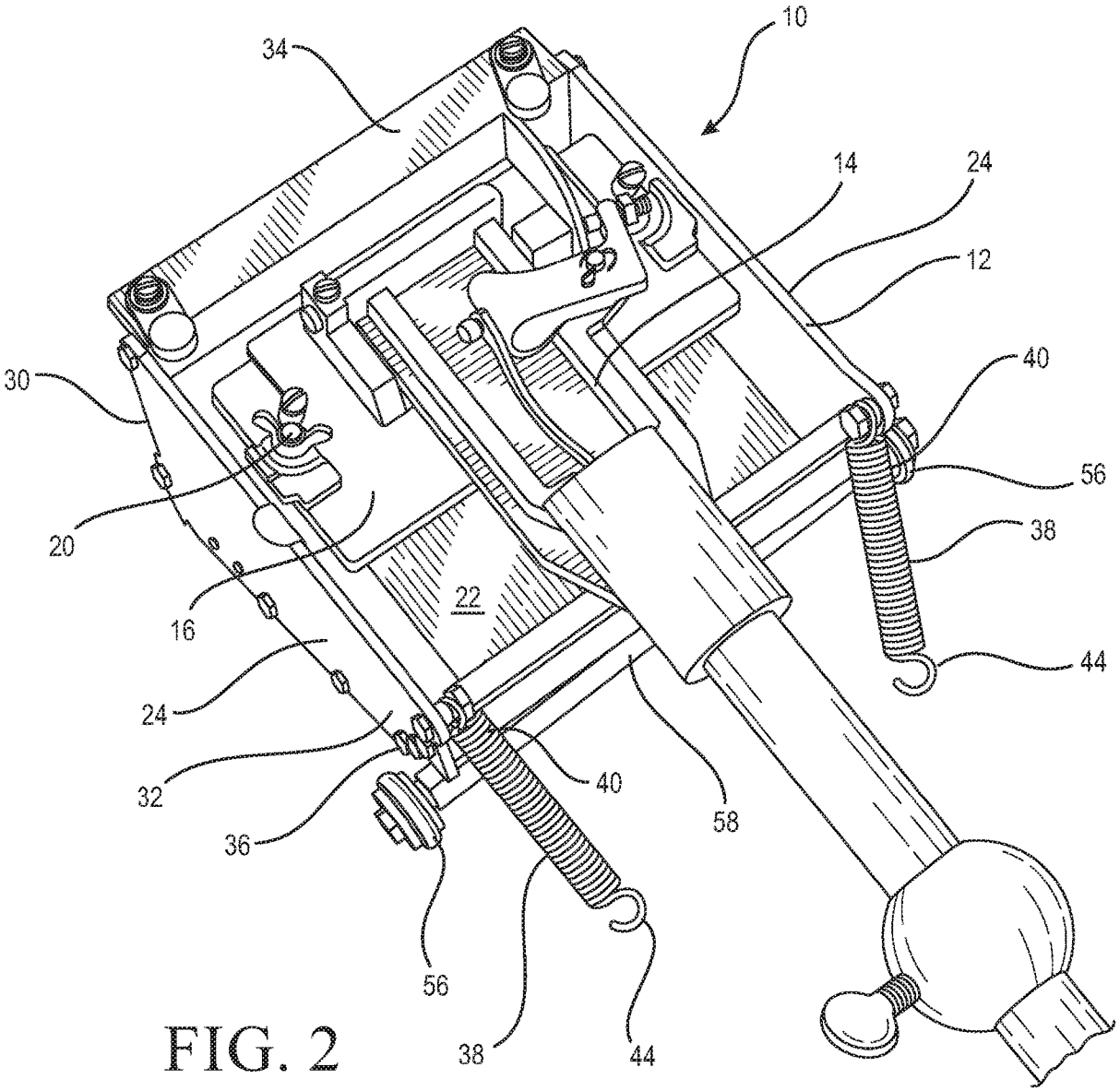
FIG. 2 is a slightly rotated top perspective view of the prefill tool of FIG. 1.

Referring now to FIGS. 1-5, the present prefill tool is generally designated 10, and includes a box assembly 12, and a pivoting handle socket bracket 14 which has a base 16 that is removably attached to the box assembly, and is constructed and arranged for receiving a conventional handle, extension pole or wand 18. As is known in the art, the box assembly 12 is made of stainless steel, aluminum, or similar sturdy, corrosion-resistant materials, and the bracket 14 is releasably connectable to studs 20 projecting from a rear wall 22 of the box assembly 12. Also included on the box assembly 22 are a pair of side walls 24, a front wall 26 and a top wall 28. Per custom, the side walls 24 are tapered or wedge shaped from a top edge 30, adjacent the top wall 28. The top edge 30 is relatively longer than an opposite bottom edge 32. Also included on the box assembly 12 is an elongate stop bar 34 which prevents rearward movement of the rear wall 22. The rear wall 22 pivots relative to the side walls 24 about an axis defined by bolts 36.

Figure 5:
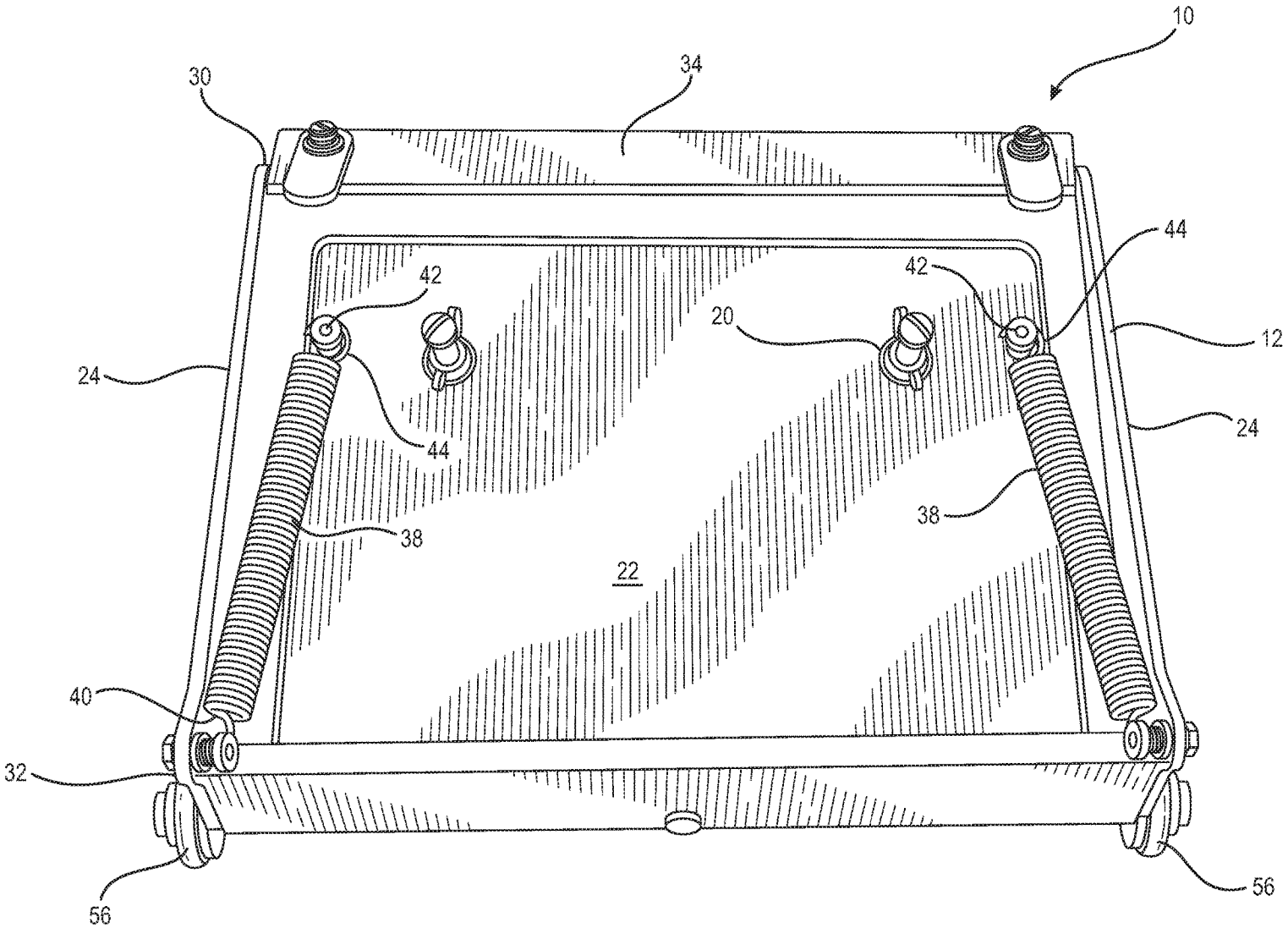
FIG. 5 is a fragmentary rear view of the present prefill tool.

A pair of return springs 38 are each connected to a corresponding side wall 24 at one end 40, and to corresponding spring lugs 42 on the rear wall 22 at opposite ends 44 (best seen in FIG. 5). In some cases, the spring end 44 is connectable to the studs 20. As is known in the art, and depicted in FIG. 1, the prefill tool 10 is placed against a wall 46 formed by adjacent wallboard panels 48 defining a wallboard seam or joint 50. The operator then presses on the rear wall 22, preferably through the handle 18 and the bracket 14 to exert an extruding force on wallboard joint compound located in a hopper 52 (shown hidden FIG. 1) defined by the box assembly 22. Thus-pressurized, the joint compound is forced from the hopper 52 through a gate 54 described below in greater detail, located on the front wall 26, from where it is applied to the joint 50.

The return springs 38 exert a biasing force to urge the rear wall 22 against the stop bar 34 against the force exerted by the operator on the handle 18. A pair of guide wheels 56 are each mounted to an axle 58 connected to the box assembly 12 near the bottom edge 32 of the side walls 24 as is well known in the art. The guide wheels 56 facilitate movement of the tool 10 along the wall 46.

Figure 3:
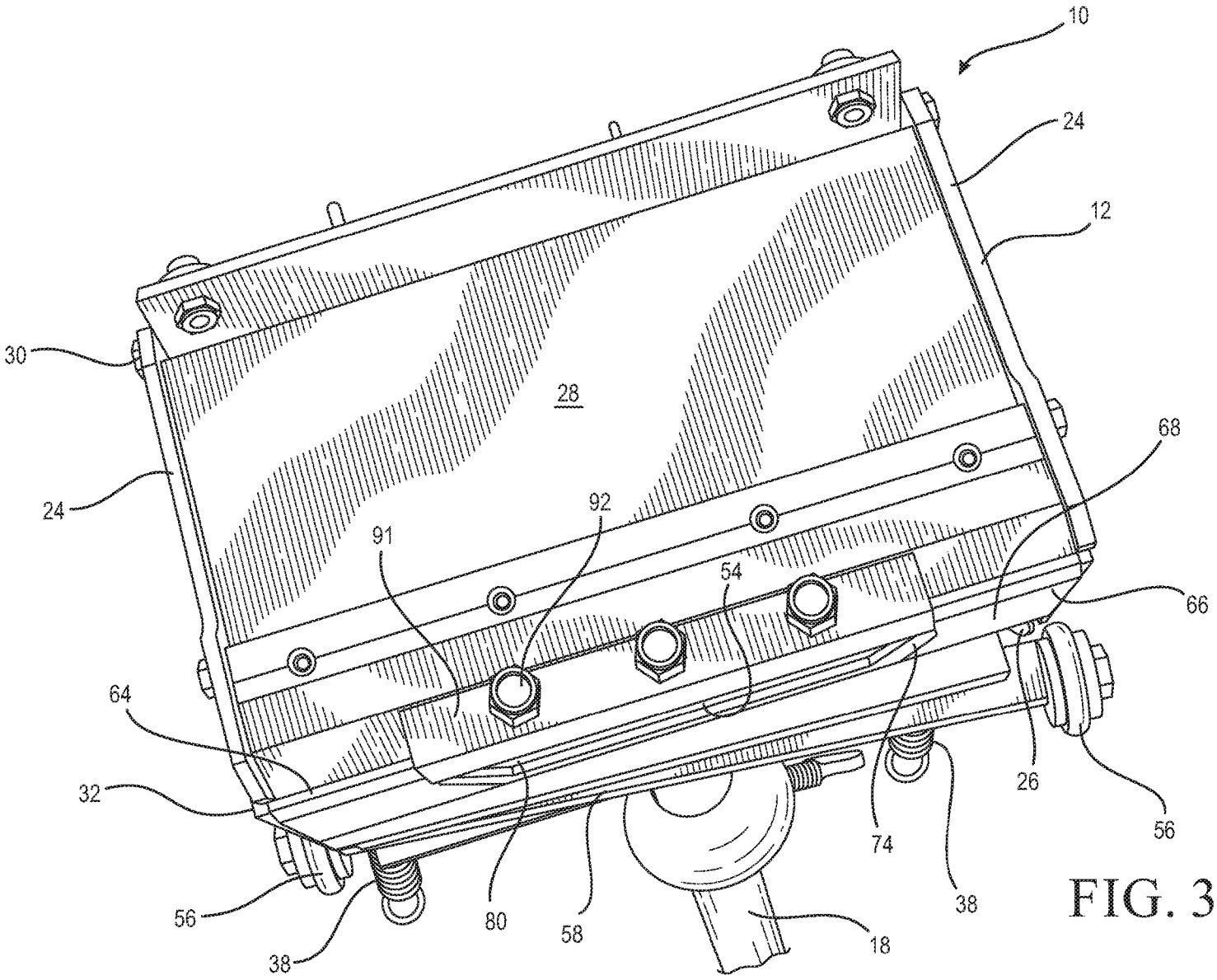
FIG. 3 is a top view of the present prefill tool.
Figure 4:
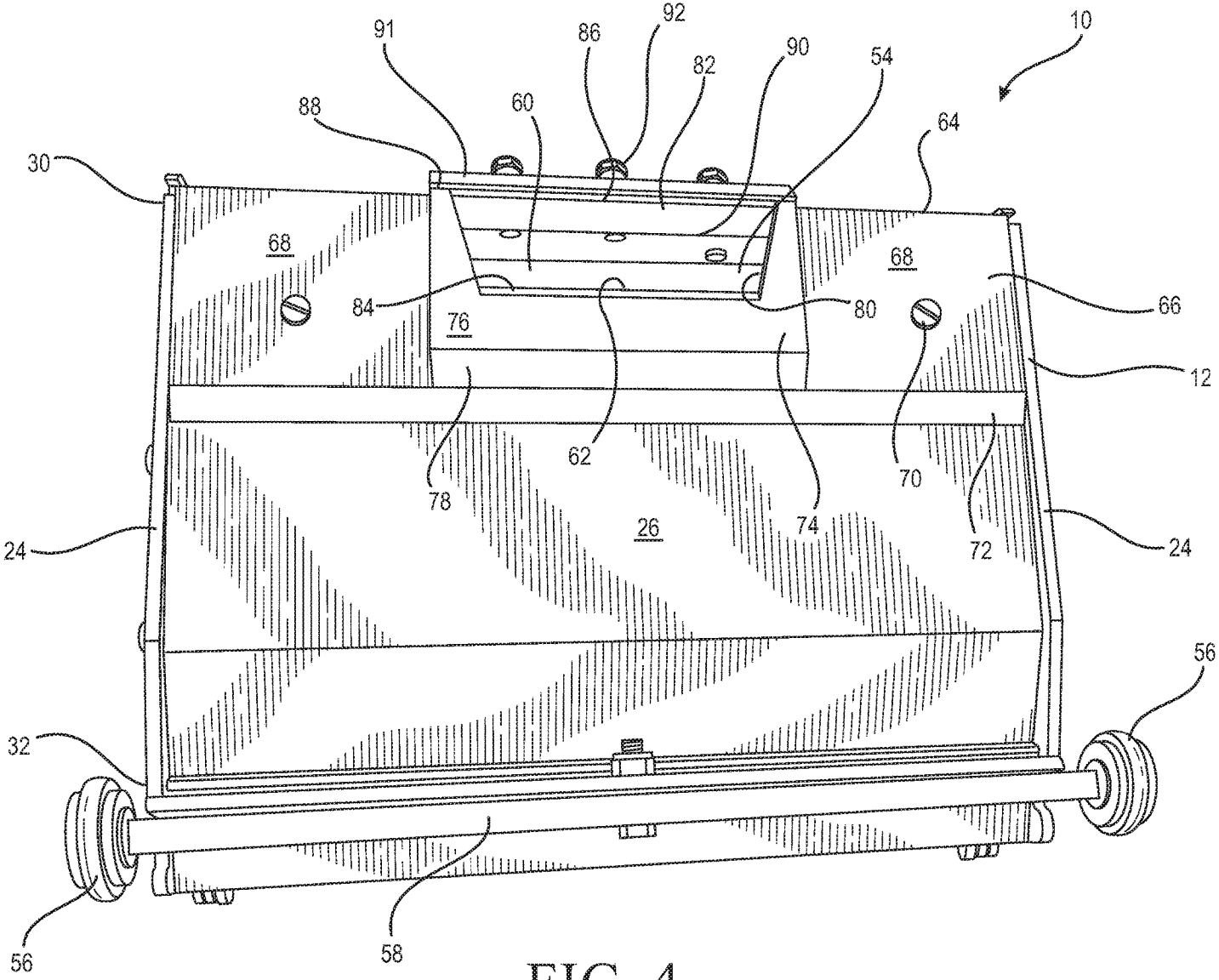
FIG. 4 is a front view of the tool of FIG. 3 showing the gate.
Figure 6:
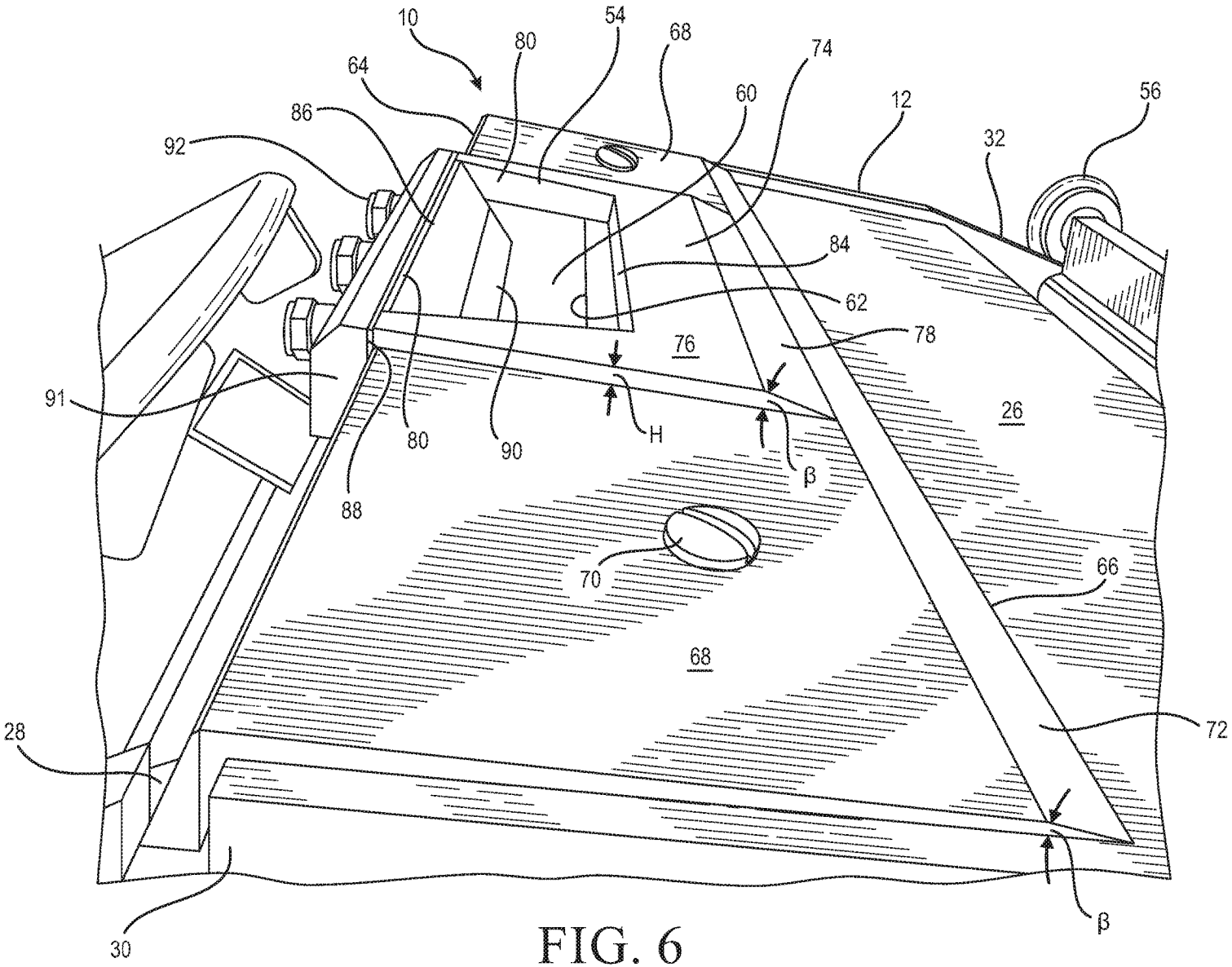
FIG. 6 is an enlarged side perspective view of the gate of the prefill tool of FIG. 4.

Referring now to FIGS. 3, 4 and 6, the gate 54 is partly defined by an opening 60 in the front wall 26, which faces the joint 50 while the tool 10 is in use. In the preferred embodiment, the opening 60 is rectangular in shape, with a long edge 62 being in spaced, parallel orientation to a top or leading edge 64 of the front wall 26, however other shapes for the opening 60 are contemplated, including circular or other polygonal configurations.

A feature of the present tool 10 is a skid plate 66, which has been found to improve the metering and distribution of wallboard joint compound emitted from the opening 60. The skid plate 66 is preferably made of stainless steel, aluminum or similar sturdy, corrosion-resistant materials, and features a main, generally planar portion 68 mounted to the front wall 26 along or adjacent to, the top edge 64. Attachment is achieved through fasteners 70, which are contemplated as screws, bolts, rivets or any other suitable known fastening technology, including adhesive. A main portion trailing edge 72 is opposite the top edge 64 and is tapered or inclined towards the bottom edge 32.

Displaced a distance "H" (FIG. 6) from a plane defined by the main portion 68 is a gate portion 74, having a contact surface 76 disposed in spaced parallel relation to the main portion 68, and also having a gate portion trailing edge 78 which is also tapered, in similar fashion, and at approximately the same angle β as the main portion trailing edge 72. Opposite the trailing edge 78, the gate portion 74 defines a gate opening 80 in fluid communication with the opening 60 and the hopper 52. Included in the gate opening 80 is a long edge 82 adjacent the top edge 64 which is longer than a short edge 84 which is in spaced parallel orientation to the long edge, so that the gate opening is preferably trapezoidal, however other shapes are contemplated, including other polygons, circles and ovals. In the preferred embodiment, the long edge 82 extends approximately one half a length of the front wall 26 at the top edge 64, however other lengths are contemplated, depending on the application.

Figure 7:
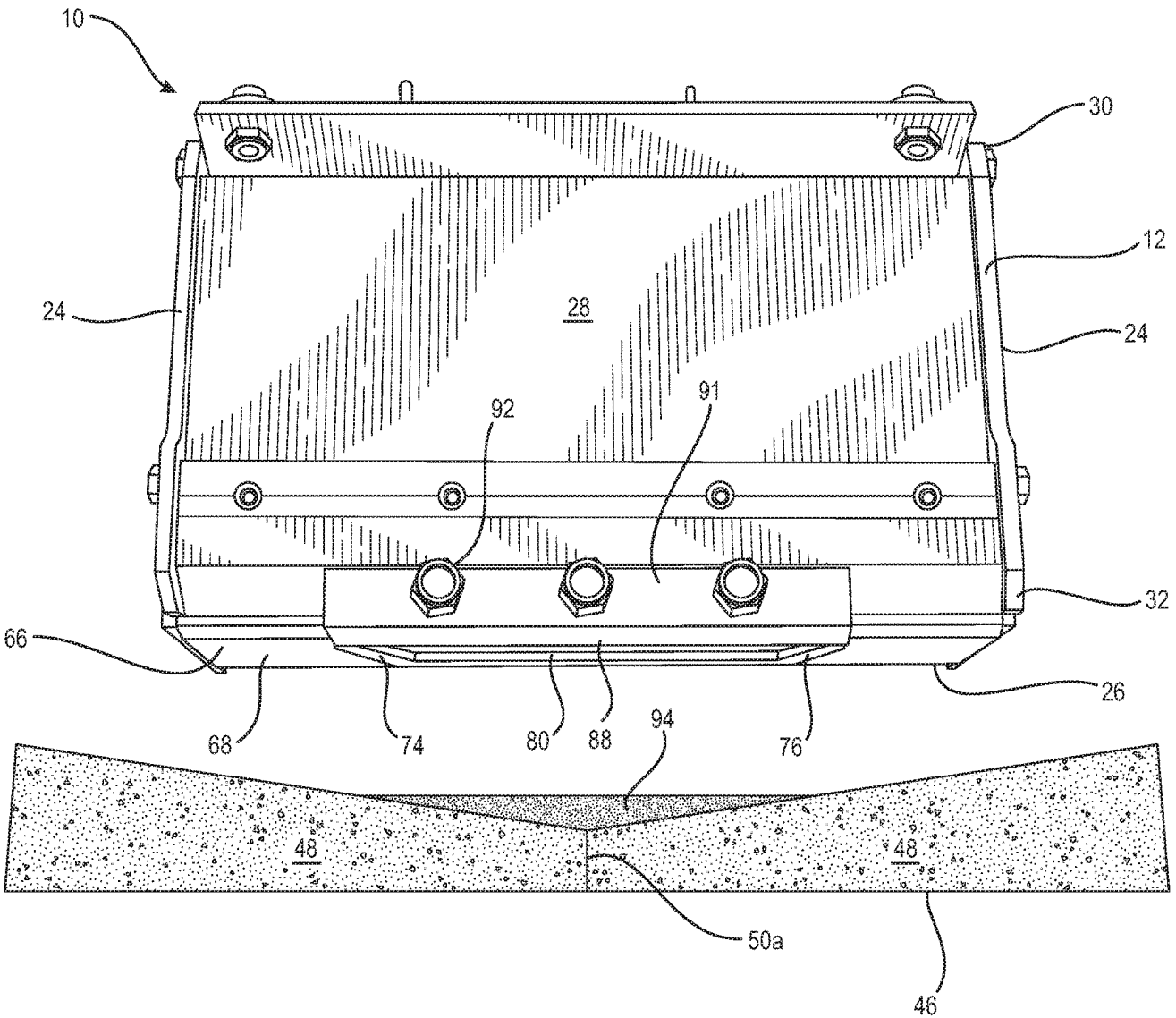
FIG. 7 is a top view of the present prefill tool shown disposed above a schematic representation of a tapered wallboard joint.
Figure 8:
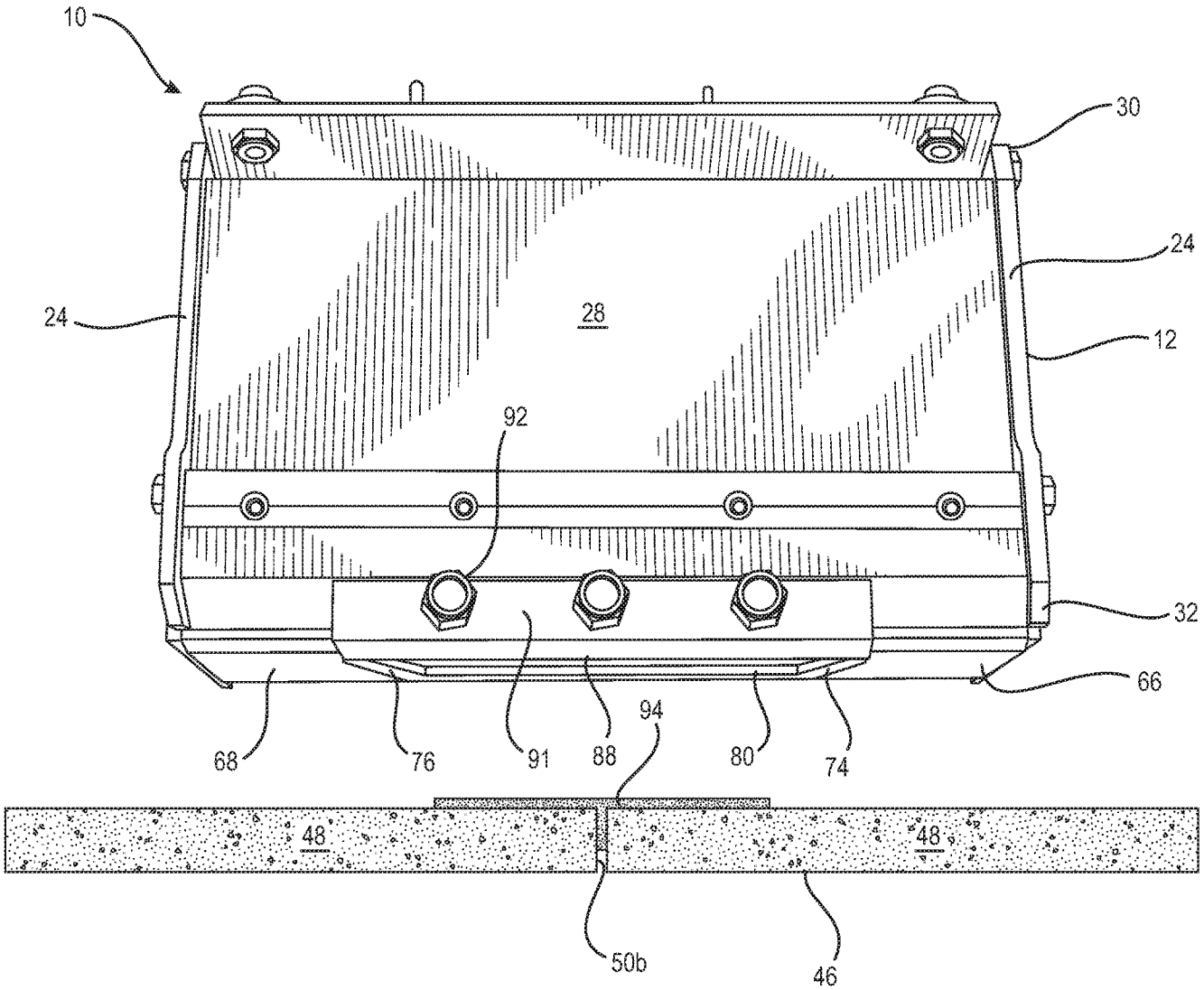
FIG. 8 is a top view of the present prefill tool shown disposed above a schematic representation of a flat wallboard joint.

The long edge 82 of the gate portion 74 is inclined towards the hopper 52 and has a base 86 adjacent a screed blade 88. A tip 90 of the long edge 82 extends towards an edge of the opening 60. The screed blade 88 is located on the box assembly adjacent the gate and is fixed in relation to the gate 54 to smooth and level the joint compound extruded through the gate during operation of the tool 10. In the preferred embodiment, the screed blade 88 is secured to the box assembly top wall 28 by a clamp 91 and several fasteners 92, preferably bolts, however other fasteners, including other threaded fasteners, are contemplated. It is especially preferred that the screed blade 88 is at least flush or level with, or extends slightly above, the gate portion 74 of the skid plate 66. Referring now to FIGS. 7 and 8, the tool 10 is seen pulled away from the wall 46 to which wallboard joint compound 94 has been applied. A main distinction between FIGS. 7 and 8 is that in FIG. 7, the panels 48 define a tapered edge joint 50*a*, and in FIG. 8, the panels 48 define a square edged joint 50*b*. regardless of the shape of the joint 50*a*, 50*b*, the present tool 10 with the skid plate 66 more effectively distributes joint compound compared to conventional tools. As seen in FIG. 1, the tool 10 is operated from an upper edge of the joint 50 to a lower edge, in the direction of travel indicated by an arrow 96.

Figure 9:
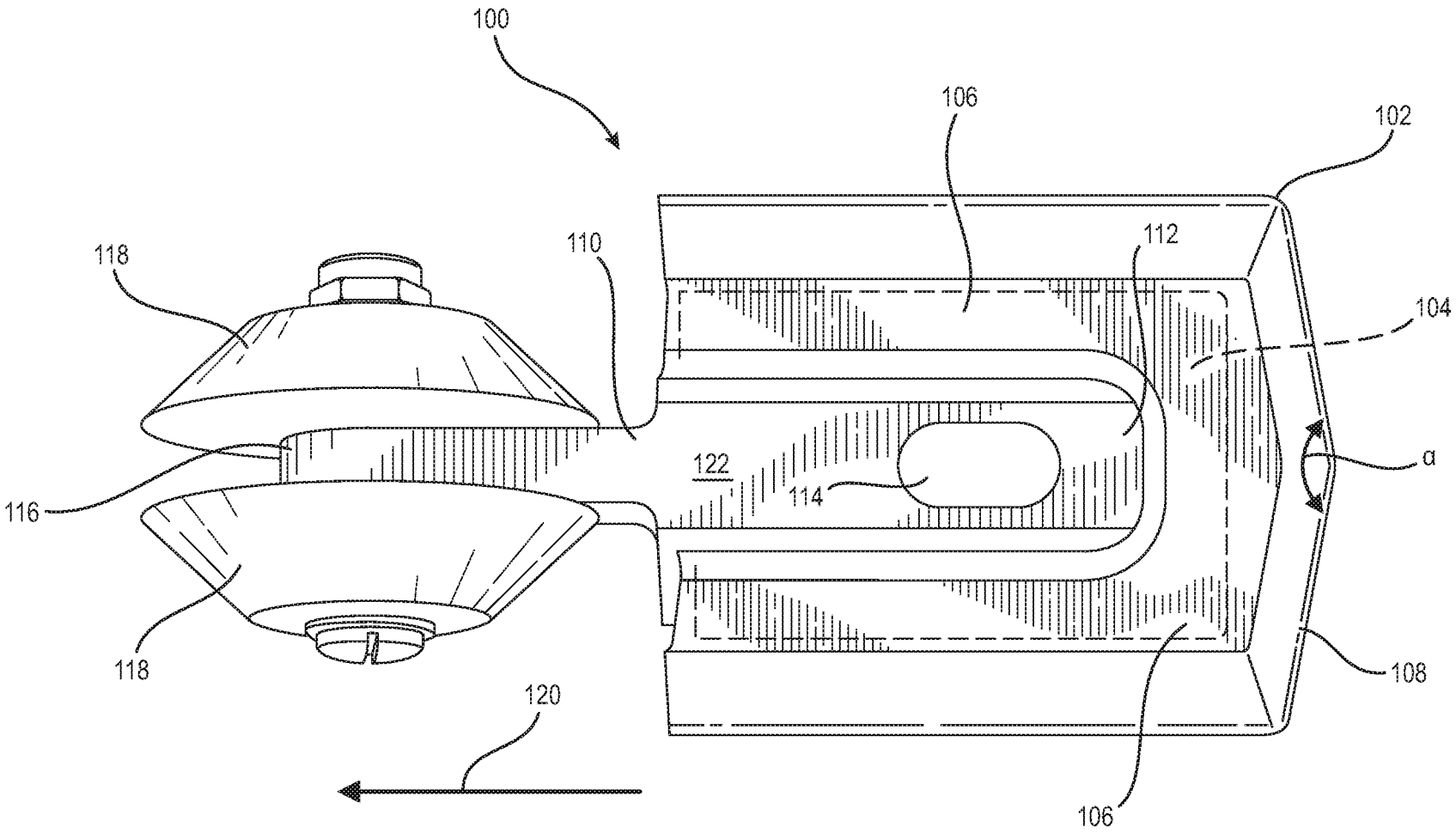
FIG. 9 is a front view of a corner applicator tool for use with the present prefill tool.
Figure 10:
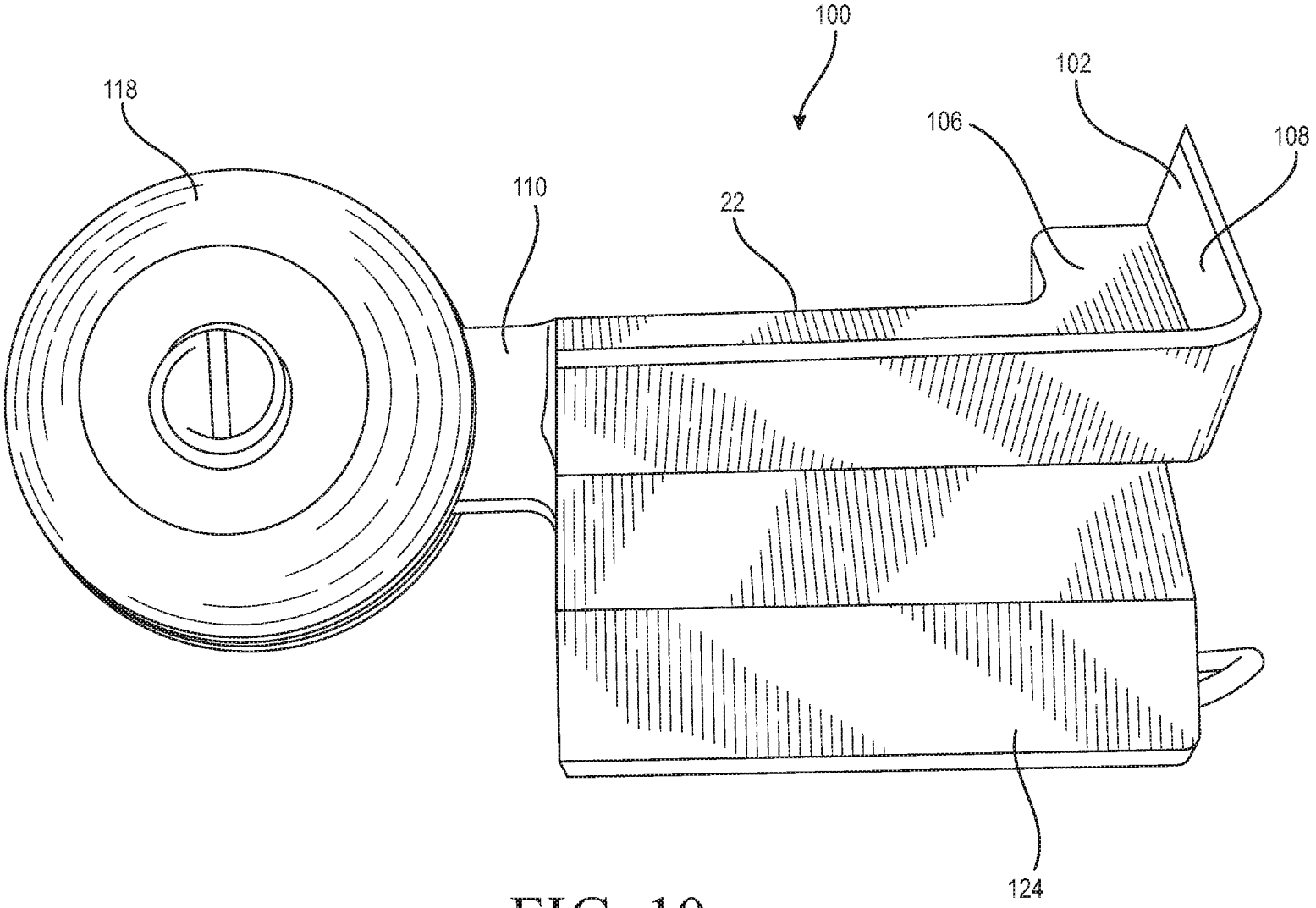
FIG. 10 is a side view of the corner applicator tool of FIG. 9.
Figure 11:
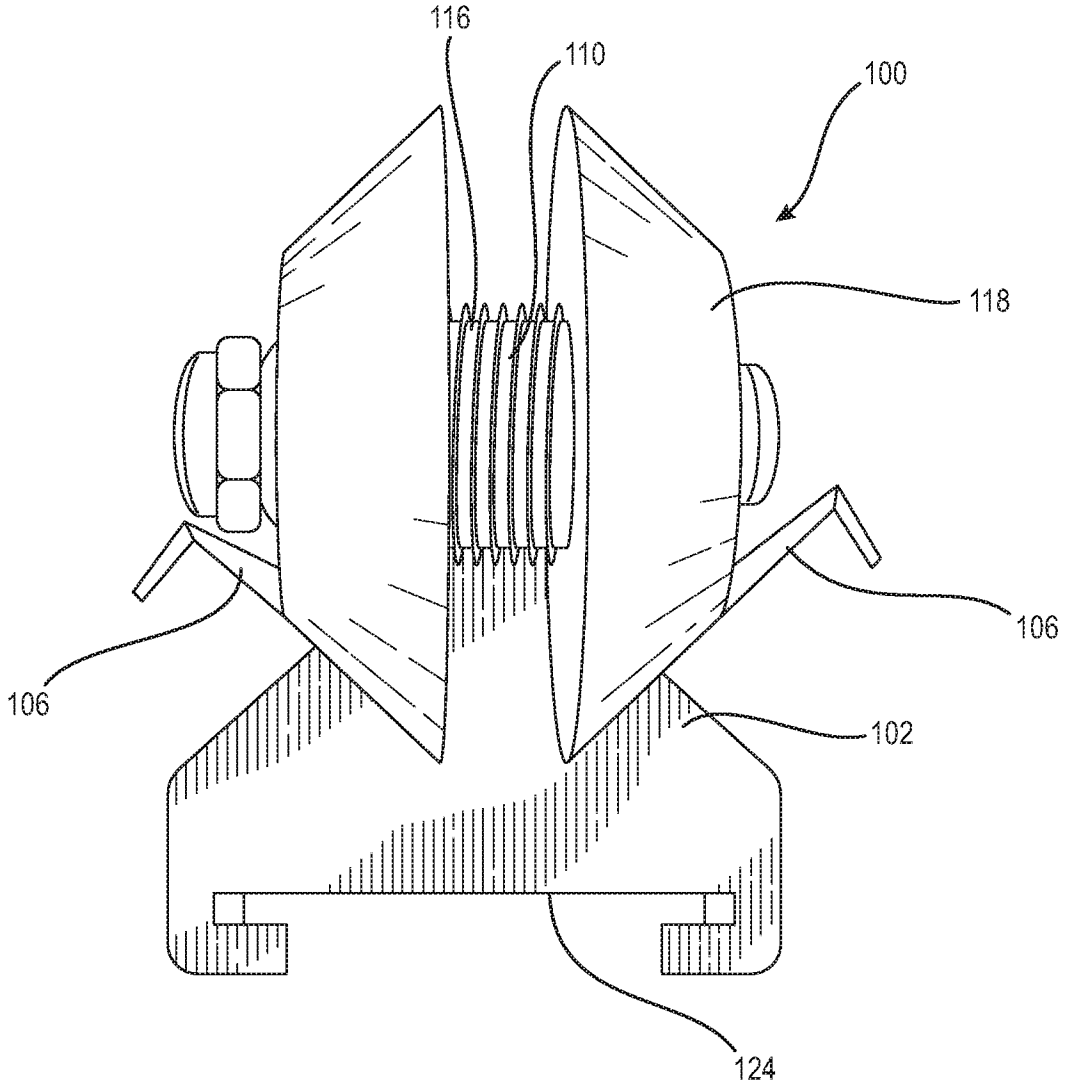
FIG. 11 is a rear view of the corner applicator tool of FIG. 9.

Referring now to FIGS. 9-11, a prefill corner applicator tool for applying joint compound to inside corners, and which incorporates principles of the tool 10 is generally designated 100. Included in the tool 100 is a housing 102 defining a hopper 104 (shown hidden FIG. 9) dimensioned for storing a supply of the joint compound 94. The hopper 104 is defined in part by a pair of guide wings 106, each forming half of an angle α complementary to the inside corner. The angle α is preferred to be approximately 90°, but may vary to suit the application. Each guide wing 106 is provided with a screed edge 108 that contacts the wallboard corner and levels the joint compound 94, similar to the screed blade 88.

A frame 110 is connected to the housing 102 and has a first end 112 with a gate 114 in fluid communication with the hopper 104, and a second end 116 having a pair of guide wheels 118, one on each side of the frame. In the preferred embodiment, the guide wheels 118 are beveled, with larger diameters positioned adjacent the frame end 116, however other configurations are contemplated. An advantage of the beveled wheels 118 is that they follow the inside wallboard corner as the tool 100 moves along the wall in the direction indicated by an arrow 120 (FIG. 9). A surface 122 of the frame 110 having the gate 114 functions similarly to the skid plate 66 described above. In addition, the frame 110 is provided with a connection point 124 (FIG. 11), such as a track or the like for releasable attachment to a handle or wand similar to the handle 18, having a fitting engaging the connection point.

Figure 12:
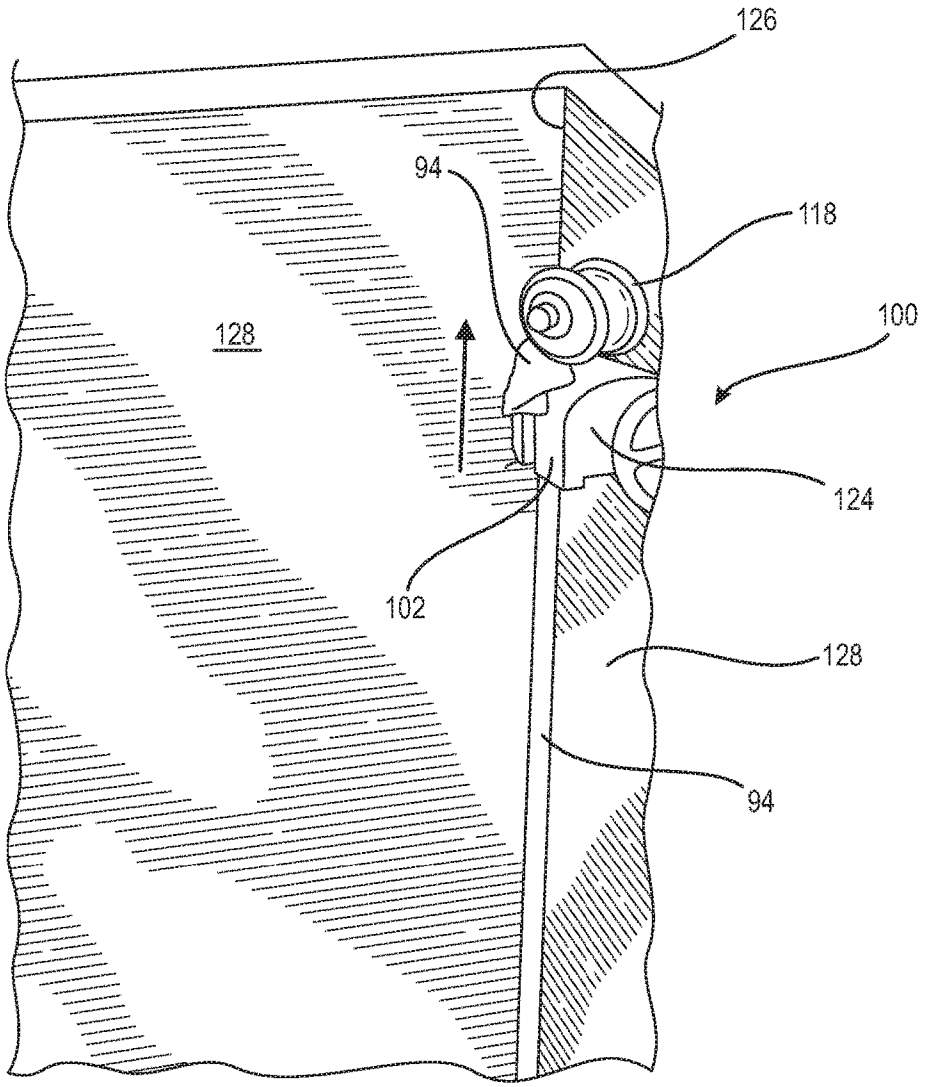
FIG. 12 is a top perspective view of the corner applicator tool of FIG. 9 shown applying wallboard joint compound to an inside corner joint.

Referring now to FIG. 12, the tool 100 is shown prefilling joint compound 94 into an inside corner joint 126 formed by common edges of panels 128. Note that the joint 126 is filled from the bottom up, with the tool 100 being moved in the direction of travel shown by the arrow 120.

While particular embodiments of the present prefill tool for finishing wallboard joints have been described herein, it will be appreciated by those skilled in the art that changes and modifications may be made thereto without departing from the invention in its broader aspects and as set forth in the following claims.

The invention claimed is:

1. A prefill tool for finishing a wallboard joint, comprising:

a box assembly defining a hopper, having a top wall and a front wall constructed and arranged for engaging the wallboard joint;

said front wall defining a gate dimensioned for dispensing joint compound stored in said hopper;

said gate being located on a skid plate mounted on said front wall, said skid plate having a skid plate main portion, and a gate portion formed on said skid plate main portion, and partially defining said gate, said gate portion being displaced vertically from a plane defined by said skid plate main portion; and said skid plate main portion and said gate portion each have an obliquely tapered trailing edge being separated from said gate.

2. The tool of claim 1, wherein said gate is in communication with said hopper and has a front edge inclined towards said hopper.

3. The tool of claim 1, wherein said gate portion defines a plane in spaced, parallel orientation relative to said skid plate main portion.

4. The tool of claim 1, wherein said trailing edge of both said skid plate main portion and said gate portion being tapered at a same angle.

5. The tool of claim 1, further including an adjustable screed blade located on said gate portion adjacent said gate.

6. The tool of claim 5, wherein said gate has a front edge inclined toward said hopper, said front edge having a base edge adjacent said screed blade.

7. The tool of claim 1, wherein said gate is trapezoidal, with a long edge adjacent said top wall and a short edge in spaced, parallel orientation to said long edge.

8. The tool of claim 7 wherein said long edge extends ½ of a width of said front wall.

9. A prefill tool for finishing a wallboard joint, comprising:

a box assembly defining a hopper, having a top wall and a front wall constructed and arranged for engaging the wallboard joint;

a pair of guide wheels mounted to said box assembly;

said front wall partially defining a gate dimensioned for dispensing joint compound stored in said hopper;

said gate being partially defined on a skid plate mounted on said front wall, said skid plate having a skid plate main portion, and a gate portion partially defining said gate being vertically displaced from a plane defined by said skid plate main portion;

said gate portion defines a plane in spaced, parallel orientation relative to said skid plate main portion;

a screed blade associated with said box assembly;

said gate having an inclined wall directed towards said hopper, and having a base adjacent said screed blade; and both said skid plate main portion and said gate portion have a tapered trailing edge, each said tapered edge having the same oblique angle, said gate portion trailing edge being displaced along a direction of travel of said prefill tool from said skid plate main portion trailing edge.

* * * * *